US012583664B2

(12) United States Patent
Drake et al.

(10) Patent No.: US 12,583,664 B2
(45) Date of Patent: Mar. 24, 2026

(54) ADJUSTABLE STORAGE SYSTEMS, ADJUSTABLE STORAGE RECEPTACLES, AND METHODS OF MANUFACTURING AND USING THE SAME

(71) Applicant: United Parcel Service of America, Inc., Atlanta, GA (US)

(72) Inventors: Dameion Teres Drake, Lawrenceville, GA (US); Julian Leland Bell, Decatur, GA (US)

(73) Assignee: United Parcel Service of America, Inc., Atlanta, GA (US)

( * ) Notice: Subject to any disclaimer, the term of this patent is extended or adjusted under 35 U.S.C. 154(b) by 863 days.

(21) Appl. No.: 17/387,696

(22) Filed: Jul. 28, 2021

(65) Prior Publication Data

US 2022/0033174 A1 Feb. 3, 2022

Related U.S. Application Data

(60) Provisional application No. 63/058,282, filed on Jul. 29, 2020.

(51) Int. Cl.
*B65D 88/00* (2006.01)
*A47G 29/12* (2006.01)
(Continued)

(52) U.S. Cl.
CPC ..... *B65D 88/005* (2013.01); *A47G 29/1218* (2013.01); *A47G 29/20* (2013.01); *B65D 88/022* (2013.01); *B65D 90/008* (2013.01)

(58) Field of Classification Search
CPC .... A47G 29/1218; A47G 29/20; A47G 29/22; A47G 29/141; B65G 1/02; B65G 1/1371;
(Continued)

(56) References Cited

U.S. PATENT DOCUMENTS 2,229,646 A * 1/1941 Firestone ..... A47G 29/1223 220/6
3,760,943 A * 9/1973 Reader ..... B07C 7/02 209/546
(Continued)

FOREIGN PATENT DOCUMENTS

CH 270400 8/1950
CN 108669993 A * 10/2018 ..... A47G 29/1201
(Continued)

OTHER PUBLICATIONS

International Search Report and Written Opinion received for PCT Patent Application No. PCT/US2021/043659, mailed on Oct. 22, 2021, 12 pages.
(Continued)

*Primary Examiner* — William L Miller
(74) *Attorney, Agent, or Firm* — Shook, Hardy & Bacon L.L.P.

(57) ABSTRACT

Adjustable storage systems, adjustable storage receptacles, and methods of manufacturing and using the same are disclosed. In one aspect, an adjustable storage system includes a plurality of adjustable storage receptacles, each of which may include a housing, an opening/closing mechanism, and an expansion mechanism. The expansion mechanism may be operable to increase or decrease an interior storage volume of the associated storage receptacle, enabling greater flexibility in storing objects of different shapes and sizes, relative to a fixed-size or fixed-geometry storage receptacle. In additional aspects, a method of using an adjustable storage receptacle and a method of using an adjustable storage system are provided, and further, a method of manufacturing an adjustable storage receptacle and a method of manufacturing an adjustable storage system are provided.

15 Claims, 7 Drawing Sheets

(51) Int. Cl.
*A47G 29/20* (2006.01)
*B65D 88/02* (2006.01)
*B65D 90/00* (2006.01)

(58) Field of Classification Search
CPC ..... B07C 3/00; B65H 31/00; B65D 88/005; B65D 88/022; B65D 90/008; B65D 21/086
See application file for complete search history.

(56) References Cited

U.S. PATENT DOCUMENTS 5,109,987 A 5/1992 Daboub et al.
5,413,410 A * 5/1995 Mlakar ..... B65D 88/14 312/293.3
5,794,789 A 8/1998 Payson et al.
10,028,606 B1 * 7/2018 Ritchie ..... G07C 9/00912
10,299,617 B1 * 5/2019 Castellanos ..... A47G 29/141
10,743,693 B2 * 8/2020 Newcomb ..... E06B 7/32
10,772,451 B2 * 9/2020 Vernal Silva ..... A47G 29/20
10,968,012 B1 * 4/2021 Ward ..... B65D 11/1833
11,087,269 B2 * 8/2021 Newcomb ..... A47G 29/141
11,109,705 B2 * 9/2021 Raphael ..... A47G 29/141
11,172,777 B1 * 11/2021 Ausland ..... A47G 29/141
11,278,144 B2 * 3/2022 Vernal Silva ..... A47G 29/141
11,751,708 B2 * 9/2023 Wu ..... A47G 29/141 232/19
11,896,151 B2 * 2/2024 Myrick ..... A47G 29/22
12,137,827 B2 * 11/2024 Jenkins ..... A47G 29/141
12,178,343 B2 * 12/2024 McCutcheon ..... A47G 29/141
2003/0006275 A1 * 1/2003 Gray ..... A47G 29/14 232/19
2009/0272859 A1 11/2009 Pippin
2016/0068306 A1 * 3/2016 Heinz ..... B65D 85/70 220/6
2018/0228310 A1 * 8/2018 Enobakhare ..... A47G 29/20
2019/0261802 A1 * 8/2019 Vernal ..... A47G 29/20
2019/0300202 A1 * 10/2019 High ..... G06Q 10/08
2019/0362577 A1 * 11/2019 Vigil ..... G07C 9/27
2020/0093309 A1 3/2020 Raphael et al.
2020/0352376 A1 * 11/2020 Vernal Silva ..... A47G 29/1254
2021/0106160 A1 * 4/2021 Janas ..... A47G 29/30
2022/0031105 A1 * 2/2022 Newcomb ..... G06K 7/10366
2023/0157471 A1 * 5/2023 McCutcheon ..... A47G 29/141 232/1 R

FOREIGN PATENT DOCUMENTS

CN 110547649 A 12/2019
DE 102017003545 A1 1/2018
KR 20-2009-0009969 U 10/2009
WO 2018/029593 A1 2/2018

OTHER PUBLICATIONS

Office Action received for European Application No. 21758518.1, mailed on Feb. 6, 2025, 5 pages.
International Preliminary Report on Patentability received for PCT Patent Application No. PCT/US2021/043659, mailed on Feb. 9, 2023, 8 pages.

* cited by examiner

ADJUSTABLE STORAGE SYSTEMS, ADJUSTABLE STORAGE RECEPTACLES, AND METHODS OF MANUFACTURING AND USING THE SAME

CROSS-REFERENCE TO RELATED APPLICATIONS AND PRIORITY CLAIM

This Non-Provisional Patent Application claims priority to U.S. Provisional Patent App. No. 63/058,282, filed Jul. 29, 2020, and titled "Adjustable Storage Systems, Adjustable Storage Receptacles, and Methods of Manufacturing and Using the Same," the entire contents of which is incorporated herein by reference.

TECHNICAL FIELD

The field relates to storage of objects.

BACKGROUND

There is frequently a need, e.g., in a logistics network operation, to store objects in storage receptacles. However, in certain circumstances, storage receptacles of a fixed size may not be suitable for storing certain objects or certain combinations of objects. Therefore, storage receptacles that are more adaptable, or adjustable, are needed.

SUMMARY

This summary is intended to introduce a selection of concepts in a simplified form that are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, adjustable storage systems, adjustable storage receptacles, and methods of manufacturing and using the same. The storage receptacles described herein may be adjustable, e.g., modifiable, allowing them to have different interior storage volumes. This allows different volumes of objects, e.g., parcels with contents, to be stored in such storage receptacles, providing greater flexibility. The storage receptacles described herein may include different housings that are used to at least partially enclose, hold, and/or support objects. The storage receptacles described herein may further include different opening/closing mechanisms that allow for selective access to an interior of the storage receptacles. The storage receptacles described herein may further include different expansion mechanisms that are operable to increase or decrease an interior storage volume of the storage receptacles. In some aspects, the expansion mechanisms may be operated manually, and/or may be operated mechanically, e.g., in automated or semi-automated fashion, e.g., using different mechanisms, actuators, and/or control components. Further described herein are methods of manufacturing and using adjustable storage systems and adjustable storage receptacles. Overall, the embodiments described herein provide greater flexibility in handling and storing objects, e.g., in a logistics network operation, among other benefits.

In one embodiment, an adjustable storage system is provided. The adjustable storage system comprises a plurality of storage receptacles, each storage receptacle comprising a housing, and an opening/closing mechanism coupled to the housing, the opening/closing mechanism configured to transition between a closed configuration and an open configuration; and a plurality of expansion mechanisms, each expansion mechanism coupled to one of the plurality of storage receptacles and operable to increase or decrease an interior storage volume of the storage receptacle.

In another embodiment, a method of using an adjustable storage system comprising a plurality of storage receptacles each having an opening/closing mechanism and an expansion mechanism that is operable to increase or decrease an interior storage volume of the storage receptacle is provided. The method comprises adjusting a first expansion mechanism coupled to a first storage receptacle to increase an interior storage volume of the first storage receptacle; placing a plurality of objects into the first storage receptacle; and transitioning the opening/closing mechanism of the first storage receptacle from a closed configuration to an open configuration to release the plurality of objects.

In another embodiment, a method of manufacturing an adjustable storage system is provided. The method comprises coupling together a plurality of storage receptacles, each storage receptacle comprising a housing, and an opening/closing mechanism coupled to the housing, the opening/closing mechanism configured to transition between a closed configuration and an open configuration; and coupling a plurality of expansion mechanisms to the plurality of storage receptacles, respectively, such that each expansion mechanism is operable to increase or decrease an interior storage volume of the associated storage receptacle.

The term "storage receptacle," as used herein, should be interpreted broadly, to include any structure, of any size, shape, or configuration, that is useable for holding, supporting, and/or storing objects. The term "object" as used herein, should also be interpreted broadly, to include any one or combination of items. In one aspect, an "object" may be a parcel with contents intended for a particular destination, e.g., in a logistics network. In this respect, any of the embodiments described herein may be used in a logistics network operation, e.g., one that operates to transfer parcels to designated destinations for delivery, e.g., using one or more common carriers.

BRIEF DESCRIPTION OF THE DRAWINGS

The adjustable storage systems, adjustable storage receptacles, and methods of manufacturing and using the same disclosed herein are described in detail with reference to the attached drawing figures, which are intended to illustrate non-limiting examples, wherein.

DETAILED DESCRIPTION

Figure 1:
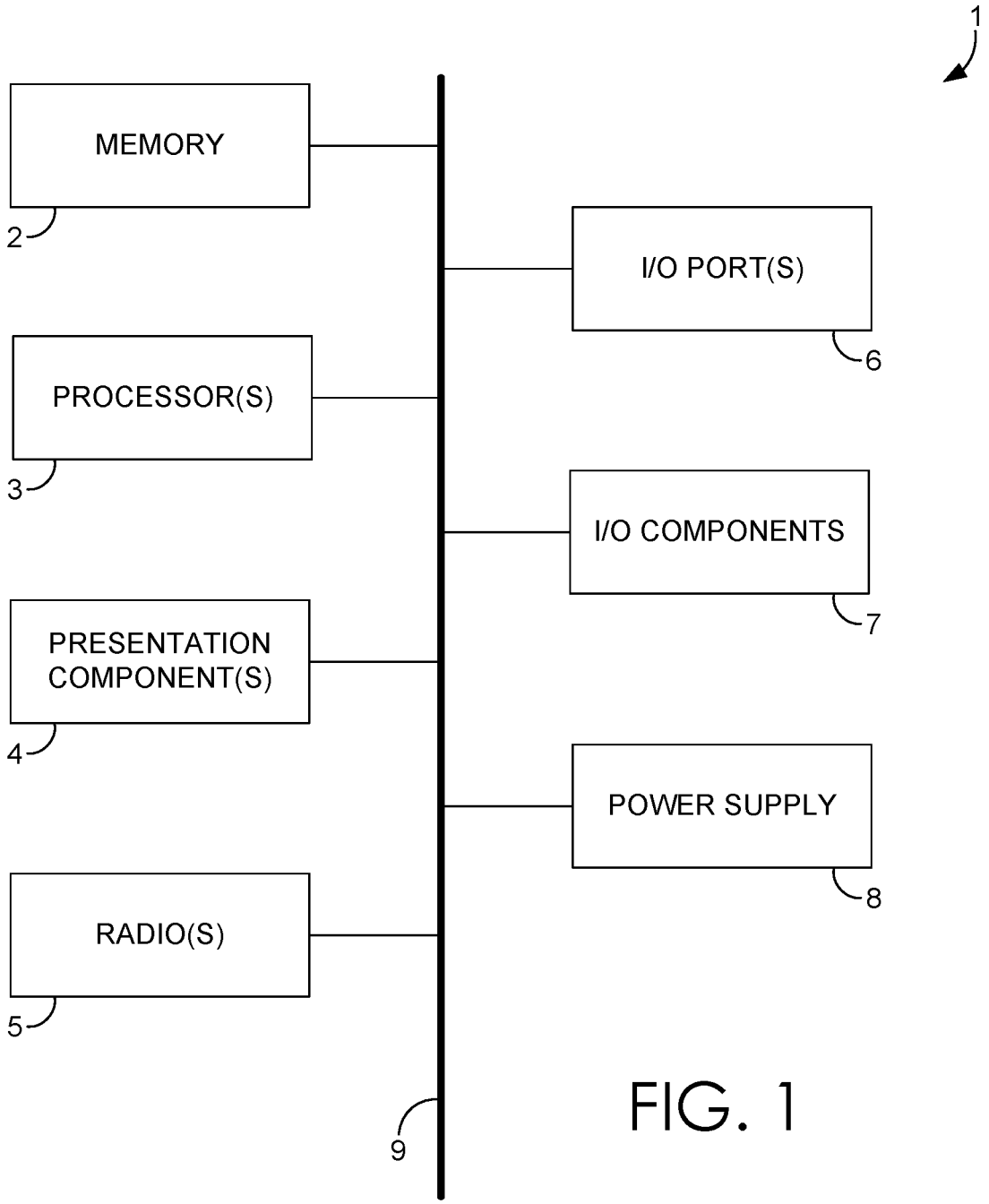
FIG. 1 depicts an example computing system suitable for supporting operation of the embodiments described herein.

This detailed description is provided in order to meet statutory requirements. However, this description is not intended to limit the scope of the invention. Rather, the claimed subject matter may be embodied in other ways, to include different steps, different combinations of steps, different features, and/or different combinations of features, similar to those described in this disclosure, and in conjunction with other present or future technologies. Moreover, although the terms "step" and "block" may be used herein to identify different elements of methods employed, the terms should not be interpreted as implying any particular order among or between different elements except when the order is explicitly stated.

In general, this disclosure describes adjustable storage systems, adjustable storage receptacles, and methods of manufacturing and using the same. In one embodiment, an adjustable storage system may include one or more adjustable storage receptacles. The adjustable storage receptacles may include features that allow their interior storage volume to be changed, or modified, as needed to store different objects. For example, an expansion mechanism may be coupled to an adjustable storage receptacle, the expansion mechanism operable to increase or decrease an interior storage volume of the storage receptacle. Further, an opening/closing mechanism may be coupled to the adjustable storage receptacle and used to secure, permit access to, and/or release objects from an interior storage volume of the adjustable storage receptacle. Further aspects are described in detail below with reference to attached FIGS. 1-8.

The subject matter described herein may be implemented as a method, a system, and/or a computer-program product, among other things. Accordingly, certain aspects may take the form of hardware, or software, or may be a combination of software and hardware. A computer-program that includes computer-useable instructions embodied on one or more computer-readable media may also be used. The subject matter described herein may further be implemented as hard-coded into the mechanical design of computing components and/or may be built into an adjustable storage system and/or an adjustable storage receptacle or associated component thereof.

The computer-readable media described herein may include volatile media, non-volatile media, removable media, and non-removable media, and may also include media readable by a database, a switch, and/or various other network devices. Network switches, routers, and related components are conventional in nature, as are methods of communicating with the same, and thus, further elaboration is not provided here. By way of example, and not limitation, computer-readable media may include computer storage media and/or non-transitory communications media.

The computer storage media, or machine-readable media, described herein may include media implemented in any method or technology for storing information. Examples of stored information include computer-useable instructions, data structures, program modules, and/or other data representations. Computer storage media may include, but is not limited to, RAM, ROM, EEPROM, flash memory or other memory technology, CD-ROM, digital versatile discs (DVD), holographic media or other optical disc storage, magnetic cassettes, magnetic tape, magnetic disk storage, and other storage devices. These memory components may store data momentarily, temporarily, and/or permanently, and are not limited to the examples provided here.

Referring now to FIG. 1, a block diagram of an example computing device 1 suitable for supporting the operations described herein is provided, in accordance with an embodiment hereof. It should be understood that although some components depicted in FIG. 1 are shown in the singular, they may be plural, and the components may be connected in a different, e.g., local or distributed, configuration. For example, computing device 1 might include multiple processors and/or multiple radios. As shown in FIG. 1, computing device 1 includes a bus 9 that directly or indirectly connects different components together, including memory 2, processor(s) 3, presentation component(s) 4 (if applicable), radio(s) 5, input/output (I/O) port(s) 6, input/output (I/O) component(s) 7, and power supply 8.

The memory 2 may take the form of the memory components described herein. Thus, further elaboration will not be provided here, but memory 2 may include any type of tangible medium that is capable of storing information, such as a database. A database may include any collection of records, data, and/or other information. In one embodiment, memory 2 may include a set of computer-executable instructions that, when executed, perform different functions or steps described herein. These instructions will be referred to as "instructions" or an "application" for short. The processor 3 may actually be multiple processors that may receive instructions and process them accordingly. The presentation component 4 may include a display, a speaker, a screen, a portable digital device, and/or other components that can present information through visual, auditory, and/or other tactile cues (e.g., a display, a screen, a lamp, a light-emitting diode (LED), a graphical user interface (GUI), and/or a lighted keyboard).

The radio 5 may support communication over a network, and may additionally or alternatively facilitate different types of wireless communications, such as Wi-Fi, WiMAX, LTE, Bluetooth, and/or VoIP communications, among other communication protocols. In various aspects, the radio 5 may be configured to support multiple technologies, and/or multiple radios may be configured and utilized to support multiple technologies.

The input/output (I/O) ports 6 may take a variety of forms. Example I/O ports may include a USB jack, a stereo jack, an infrared port, and/or other proprietary communication ports. The input/output (I/O) components 7 may comprise one or more keyboards, microphones, speakers, touchscreens, and/or any other item useable to directly or indirectly input data into the computing device 1. The power supply 8 may include electrical sources, batteries, generators, fuel cells, and/or any other component that may act as a power source to supply power to computing device 1 and to any other components described herein.

Figure 2:
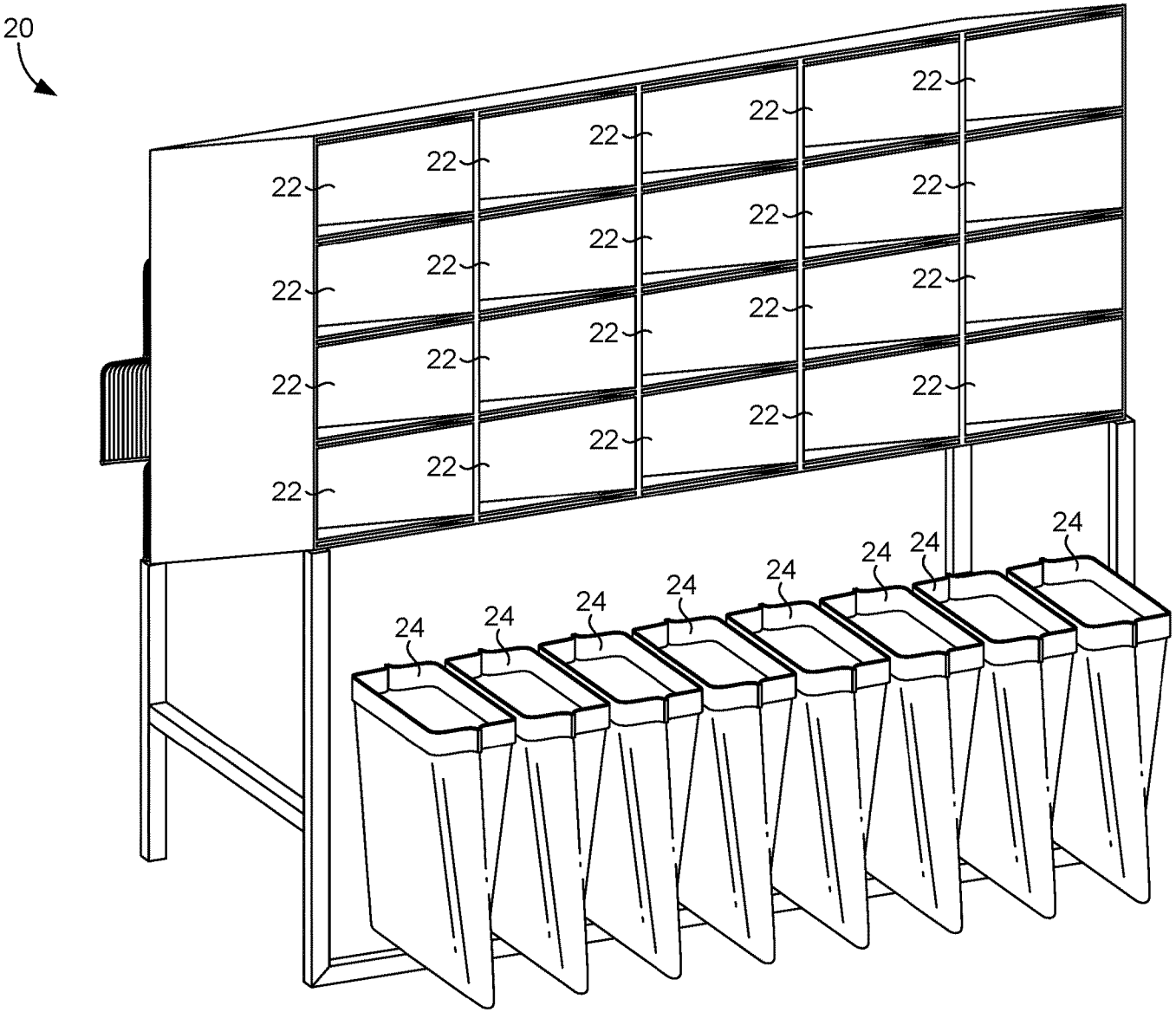
FIG. 2 depicts an adjustable storage system, in accordance with an embodiment hereof.

Referring now to FIG. 2, an adjustable storage system 20 is provided, in accordance with an embodiment hereof. The adjustable storage system 20 includes a plurality of adjustable storage receptacles 22. The adjustable storage receptacles 22 are coupled together to form the configuration shown in FIG. 2. It should be noted that with the system 20, some, or all, of the storage receptacles may be adjustable. Accordingly, in some aspects, some fixed, or non-adjustable or non-expandable storage receptacles may also be used with such a system. The system 20 further includes a plurality of storage/transport bags 24, the openings of which are oriented towards the adjustable storage receptacles 22. As shown in FIG. 2, the adjustable storage receptacles 22 are angled relative to a surface on which the adjustable storage system 20 is supported. This angled positioning facilitates the transfer of objects from the adjustable storage receptacles 22 into the storage/transport bags 24, in one aspect. In another aspect, the storage/transport bags 24 may be positioned so that objects loaded into the storage/transport bags 24 can be transferred to the adjustable storage receptacles 22. For example, the storage/transport bags 24 may be moved under the adjustable storage receptacles 22 to facilitate loading and/or unloading of objects.

Figure 3:
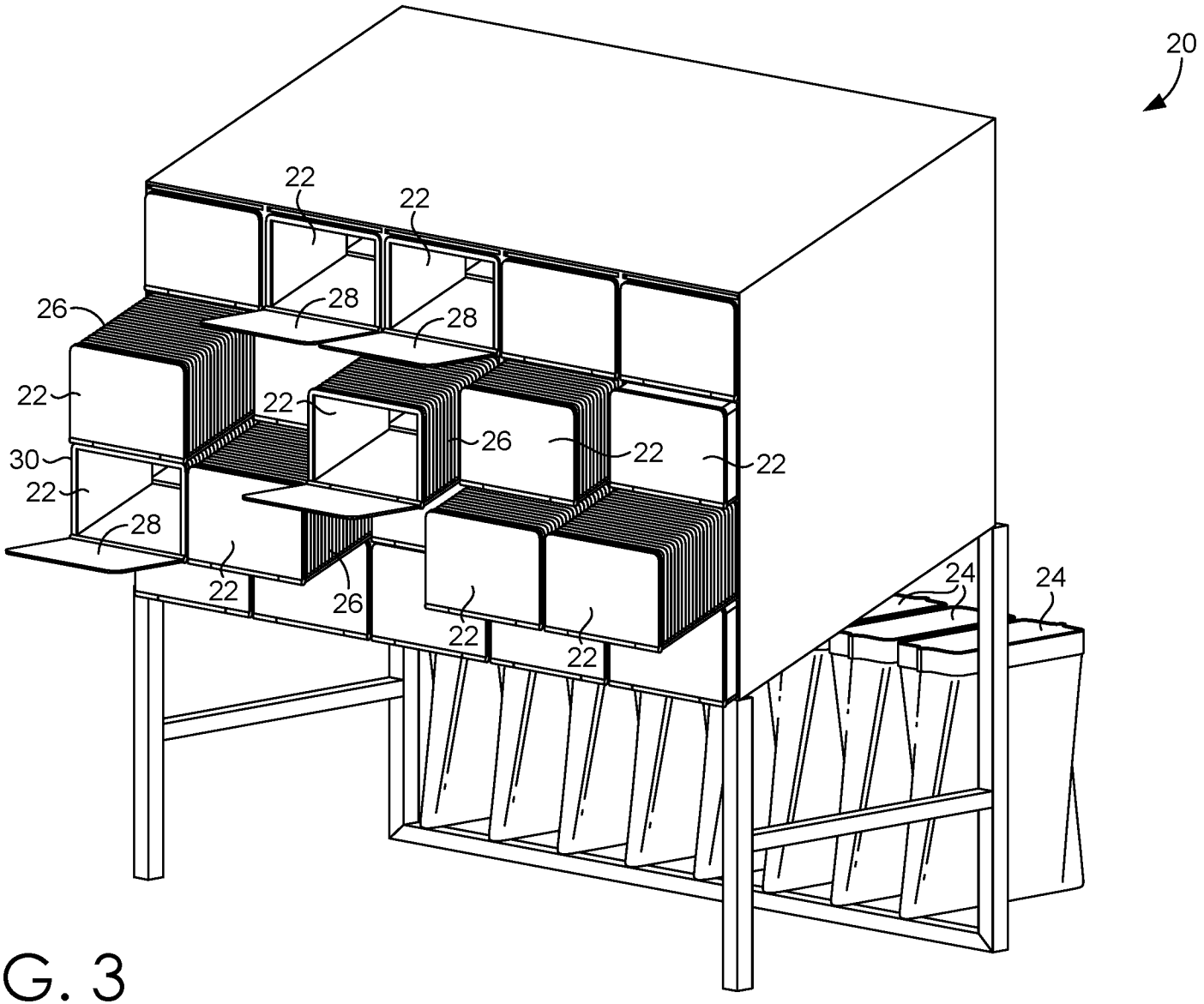
FIG. 3 depicts the adjustable storage system of FIG. 2, from a different perspective, in accordance with an embodiment hereof.

Referring now to FIG. 3, the adjustable storage system 20 of FIG. 2 is again shown, but from a different perspective, in accordance with an embodiment hereof. In particular, FIG. 3 depicts the opposite side of the adjustable storage system 20, compared to FIG. 2. FIG. 3 further depicts how each adjustable storage receptacle 22 includes an expansion mechanism 26 that is operable to increase or decrease the interior storage volume of the adjustable storage receptacle 22. This allows the available storage space to be changed, without the need to install new storage receptacles of a fixed size or geometry. FIG. 3 also depicts how each adjustable storage receptacle 22 includes an opening/closing mechanism 28 that is coupled to a housing 30 of the adjustable storage receptacle 22. The opening/closing mechanism 28 is configured to transition between a closed configuration and an open configuration, to thereby increase or decrease access to the interior storage space of the adjustable storage receptacle 22. In some aspects, the opening/closing mechanisms 28 may be securable. For example, each opening/closing mechanism 28 may include a locking mechanism. The locking mechanism may operate manually, and/or may operate mechanically, e.g., through operation of one or more mechanisms, actuators, and/or control components. The locking mechanisms may also be controlled by a computing device, in additional aspects.

Figure 4:
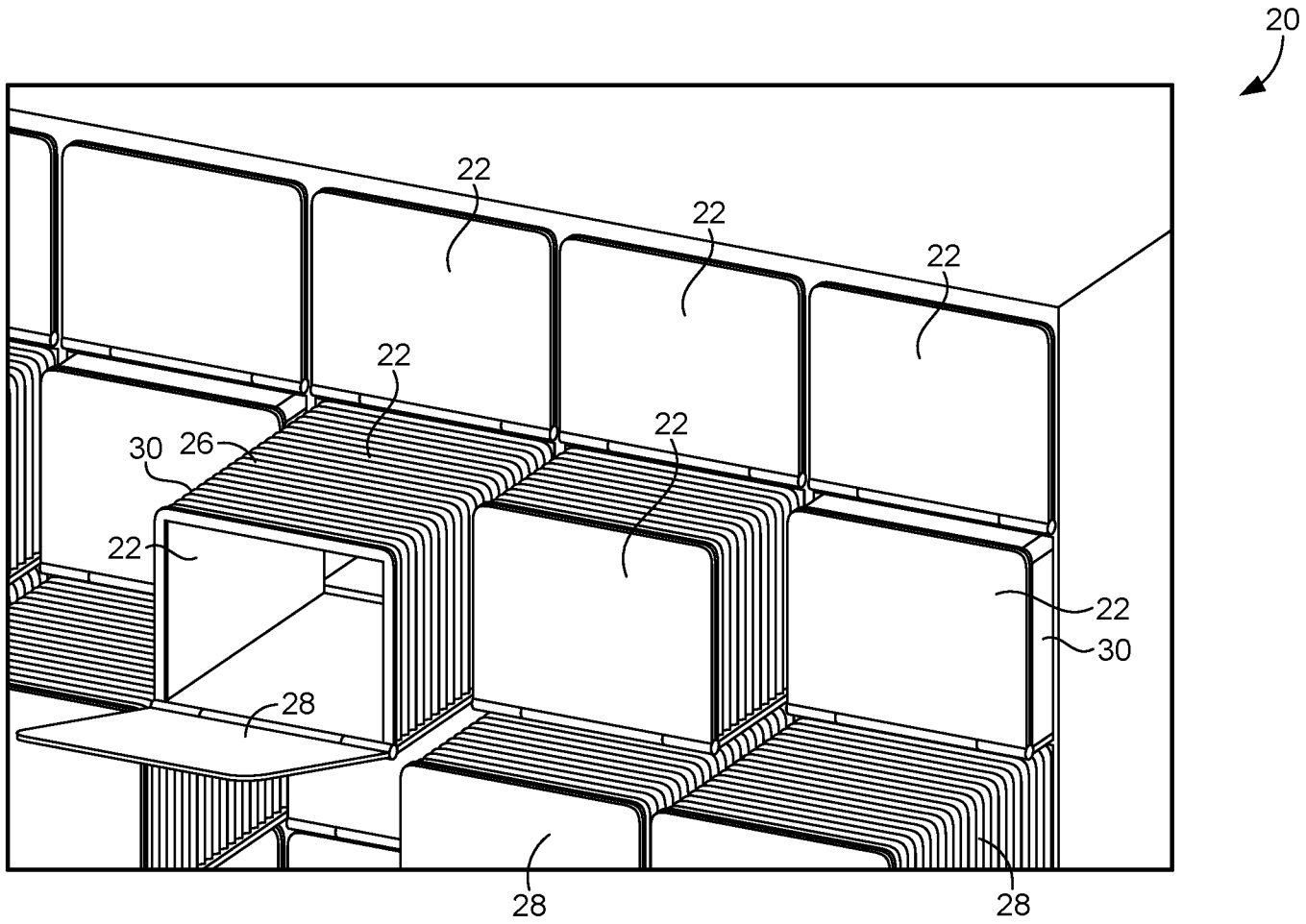
FIG. 4 depicts a close-up view of the storage system depicted in FIGS. 2 and 3, in accordance with an embodiment hereof.

Referring now to FIG. 4, the adjustable storage receptacles 22 depicted in FIGS. 2 and 3 are shown in greater detail, in accordance with an embodiment hereof. In FIG. 4, some of the adjustable storage receptacles 22 are shown with their corresponding expansion mechanisms 26 in the expanded, or extended, configuration, thereby increasing the interior storage capacity of those adjustable storage receptacles 22. Further shown in FIG. 4 is one of the opening/closing mechanisms 28 in an open configuration, exposing the interior storage space of the associated adjustable storage receptacle 22. The adjustable storage system 20 shown in FIGS. 2-4 includes storage receptacles that are elongated, with "accordion-like" mechanical expansion mechanisms, and "pivotal door-style" opening/closing mechanisms. However, this configuration represents only one non-limiting embodiment, and numerous other configurations are contemplated as within the scope of the present disclosure.

Figure 5:
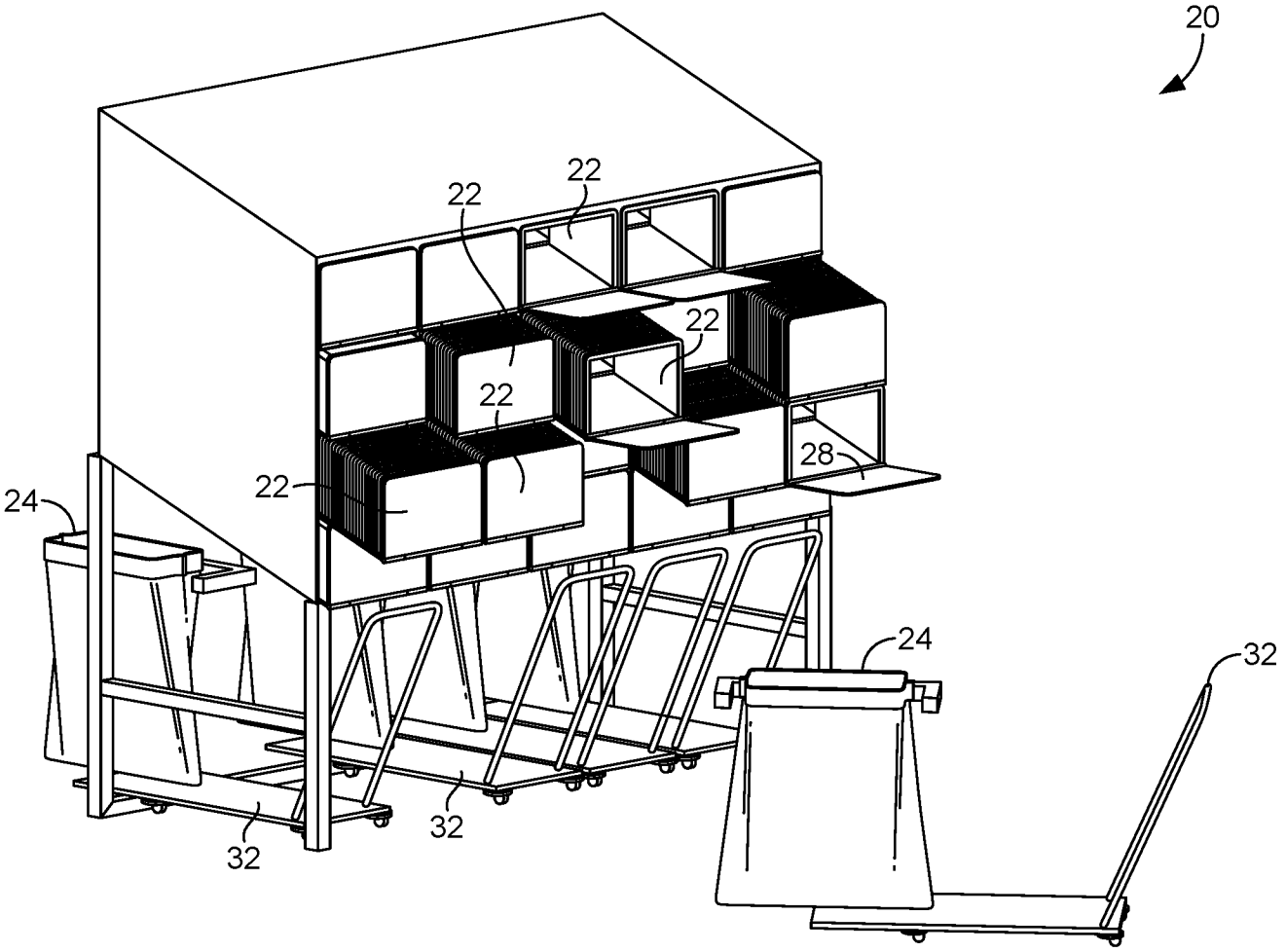
FIG. 5 depicts the adjustable storage system of FIGS. 2-4 along with a plurality of storage/transport bags, in accordance with an embodiment hereof.

Referring now to FIG. 5, the adjustable storage system 20 of FIGS. 2-4 is again shown, along with additional storage elements, in accordance with an embodiment hereof. FIG. 5 in particular depicts the adjustable storage receptacles 22 with the storage/transport bags 24, which are positioned on rolling carts 32, located below the adjustable storage receptacles 22. FIG. 5 also depicts how the adjustable storage receptacles 22 are oriented at an angle, with one end of the adjustable storage receptacles 22 at which the opening/closing mechanisms 28 are located being positioned lower, i.e., closer to a surface on which the adjustable storage system 20 is supported, than the opposite end. This allows objects stored in the adjustable storage receptacles 22 to be released, and fall into, the storage/transport bags 24. The objects may transfer out of the adjustable storage receptacles 22 by gravity, and/or may transfer out of the adjustable storage receptacles 22 with assistance from a mechanical element or mechanism (e.g., a pusher that is translated by an actuator). As shown in FIG. 5, the openings of the storage/transport bags 24 can be positioned/oriented towards the opening/closing mechanisms 28 of the adjustable storage receptacles 22, to thereby facilitate transfer of objects from the adjustable storage receptacles 22 into the storage/transport bags 24. In another aspect, the storage/transport bags 24 may be positioned under openings in the adjustable storage receptacles 22, e.g., located opposite to the opening/closing mechanisms 28, to facilitate the loading or unloading of objects to and/or from the storage/transport bags 24.

Figure 6A:
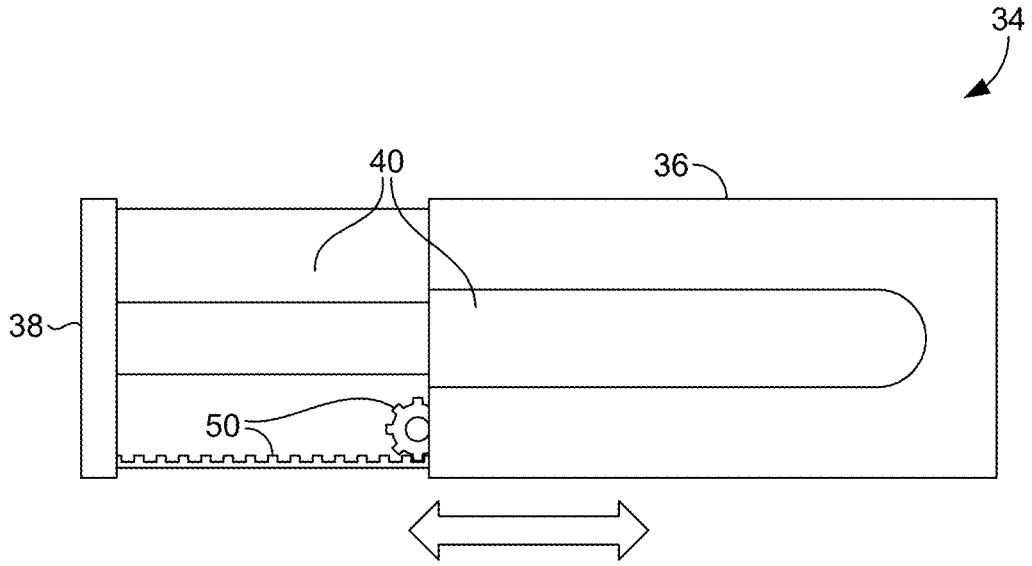
FIGS. 6A-6B depict different expansion mechanisms used with an adjustable storage receptacle, in accordance with embodiments hereof.

FIG. 6A depicts one example configuration of an adjustable storage receptacle 34, in accordance with an embodiment hereof. The adjustable storage receptacle 34 includes a housing 36, an opening/closing mechanism 38, and an expansion mechanism 40. The expansion mechanism 40 shown in FIG. 6A is represented as a mechanical, sliding assembly. This assembly allows the opening/closing mechanism 38 to translate in a linear fashion, thereby allowing the interior storage volume of the adjustable storage receptacle 34 to be modified, e.g., increasing or decreasing its storage capacity.

Figure 6B:
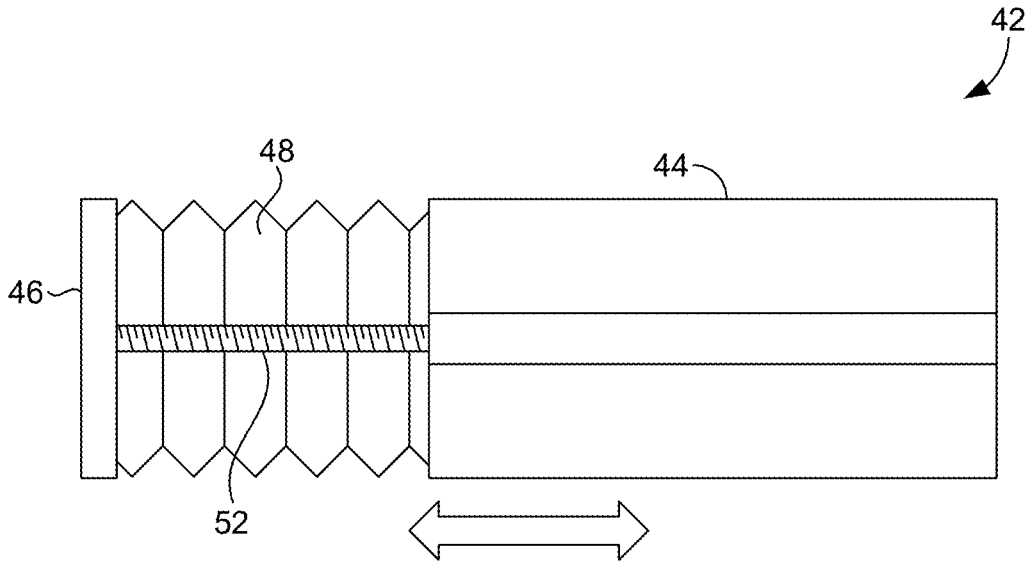

FIG. 6B depicts another example configuration of an adjustable storage receptacle 42, in accordance with an embodiment hereof. The adjustable storage receptacle 42 includes a housing 44, an opening/closing mechanism 46, and an expansion mechanism 48. The expansion mechanism 48 is represented as an "accordion-like" mechanical expansion device, which allows the opening/closing mechanism 46 to translate in a linear fashion, thereby allowing the interior storage volume of the adjustable storage receptacle 42 to be modified, e.g., increasing or decreasing its storage capacity. In additional aspects, other expansion mechanisms may be used in place of those depicted in FIGS. 6A and 6B. For example, different components, mechanisms, and/or actuators that are adapted to shift, extend, retract, expand, and/or contract parts of the adjustable storage receptacles may be utilized. In addition, the adjustable storage receptacles may include, or be formed of, non-rigid or flexible or pliable materials that are able to change geometry, to accommodate the different expanded configurations, while at least partially maintaining a storage envelope, so that objects do not fall out of the adjustable storage receptacles when storage capacity is increased.

In different embodiments, the adjustable storage systems and adjustable storage receptacles described herein may be adjusted, e.g., extended or retracted, expanded or contracted, etc., either passively, or actively, or a combination of both.

In different embodiments, the housings of the adjustable storage receptacles described herein may include one or more walls, which may be fixed, movable, rigid, non-rigid (e.g., flexible or pliable, allowing for a change in geometry), or any combination thereof.

In different embodiments, the opening/closing mechanisms described herein may include doors, e.g., that are pivotally coupled to a housing, slidably coupled to a housing, rollably coupled to a housing, or that are otherwise adjustable or movable relative to a housing of an adjustable storage receptacle. In one aspect, a pivotal door may be used and may be coupled to a housing with one or more hinges. In another aspect, a rolling door may be used, which may be formed of rigid material sections that are joined together to form a sheet that is rigid in two directions, but flexible in another direction, thereby allowing the door to roll up and down. The opening/closing mechanism may further utilize an Iris-style mechanism that is implemented with rigid panels, flexible materials, or other elements that enable it to transition between a closed configuration and an open configuration. In further aspects, the opening/closing mechanism may be configured and may operate so that interference with adjacent storage receptacles is limited or reduced.

In different embodiments, the housings of the adjustable storage receptacles described herein may be formed of different materials. For example, the housings may be formed of materials that are movable, non-movable, rigid, non-rigid, see-through, non-see-through, opaque, and/or flexible, pliable, and/or stretchable, at least in part, in different aspects. For example, part of a housing may be formed of elastomers such as rubber, or of a mesh material, or of a metal, if greater rigidity and/or durability is desired. In addition, flexible portions of a housing may be augmented with rigid portions, e.g., rigid sub-members. These rigid portions may be ribs or other structural features that impart a stiffness to other flexible materials.

In different embodiments, control of the expansion mechanisms described herein may be augmented with active, closed-loop techniques. For example, a spring-retracting element may be dynamically tensioned to allow for position control under a changing load. The feedback used to enable closed-loop control may be derived from different sources, such as imaging elements located inside the adjustable storage receptacles, displacement sensors, such as reel encoders or linear encoders, weight sensors, such as load cells, and/or other elements.

In different embodiments, different parts of an adjustable storage receptacle may be movable or shiftable. For example, the side, top, bottom, and/or end portions may be movable or shiftable in differently configured storage receptacles.

In different embodiments, the expansion mechanisms and/or opening/closing mechanisms described herein may be initially integrated into the storage receptacles, or may be retrofitted to existing storage receptacles.

In different embodiments, a biasing element may be used to resist expansion, or shifting, of the adjustable storage receptacles, either passively or actively. For example, the expansion, or shifting, of a movable portion of an adjustable storage receptacle may be limited by a biasing element. This limiting may be based on some measurable quantity, such as the volume of the receptacle, the weight of objects placed in the receptacle, the available capacity of a receiving receptacle, or something else. The biasing element may be a spring-based biasing element, a magnetic-based biasing element, a dash-pot, and/or a dash-pot with a force deadband, among other possible biasing elements. In another instance, the expansion or shifting of an adjustable storage receptacle may be controlled through operation of a direct position control element, e.g., element 50 shown in FIG. 6A or element 52 shown in FIG. 6B, such as a motorized lead screw, a rack-and-pinion gear set, a wire-rope drive, a roller chain, or another mechanism. These elements may be used in any combination, in different aspects.

Figure 7:
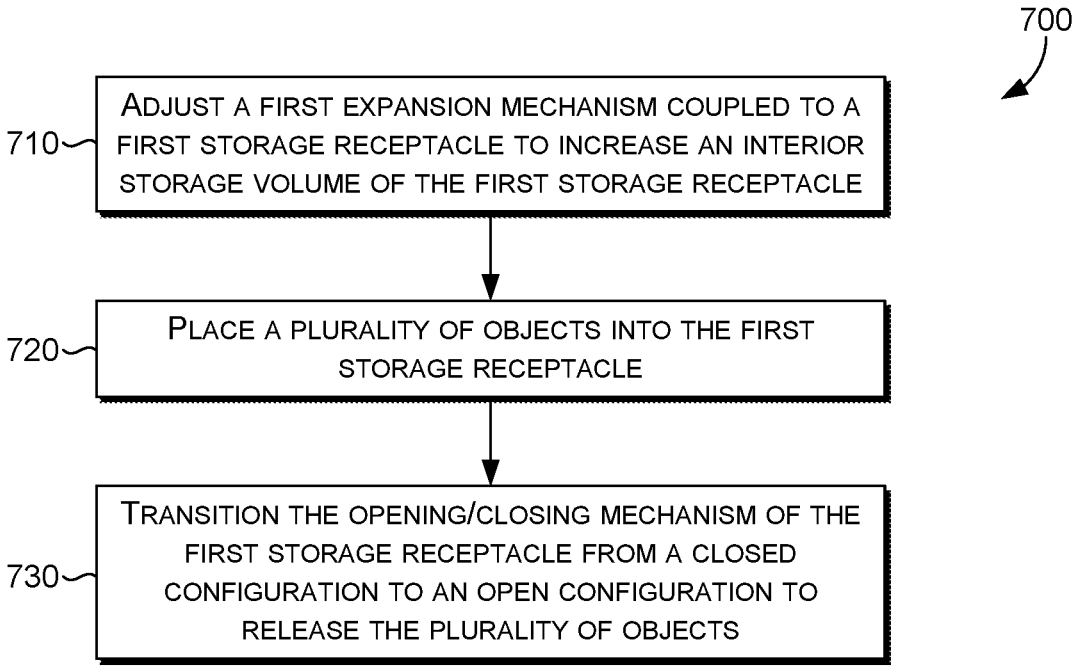
FIG. 7 depicts a block diagram of a method of using an adjustable storage system, in accordance with an embodiment hereof.

FIG. 7 depicts a block diagram of an example method 700 of using an adjustable storage system, such as the adjustable storage system 20 shown in FIG. 2, in accordance with an embodiment hereof. The method 700 is represented by blocks 710-730. At block 710, the method includes adjusting a first expansion mechanism, such as the expansion mechanism 26 shown in FIG. 2, coupled to a first storage receptacle, such as the adjustable storage receptacle 22 shown in FIG. 2, to increase an interior storage volume of the first storage receptacle. At block 720, the method includes placing a plurality of objects, such as parcels with contents, into the first storage receptacle. At block 730, the method includes transitioning an opening/closing mechanism, such as the opening/closing mechanism 28 shown in FIG. 2, from a closed configuration to an open configuration to release the plurality of objects, e.g., into another storage receptacle, such as the storage/transport bags 24 shown in FIG. 2. It should be noted that in different embodiments, the aforementioned steps may be performed in a different order.

Figure 8:
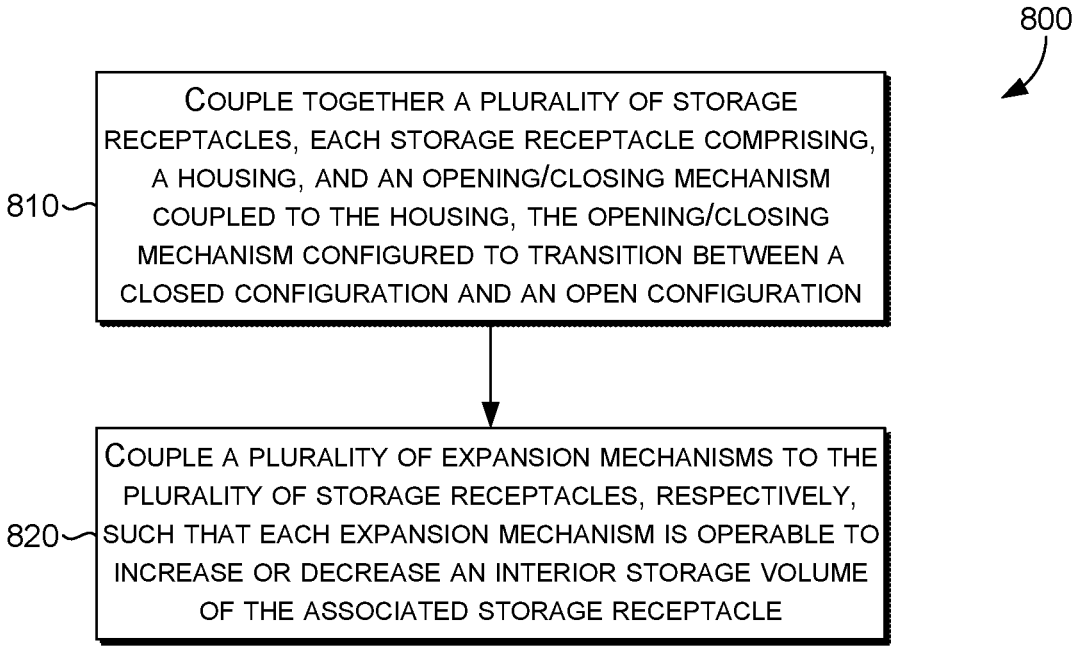
FIG. 8 depicts a block diagram of a method of manufacturing an adjustable storage system, in accordance with an embodiment hereof.

FIG. 8 depicts a block diagram of an example method 800 of manufacturing an adjustable storage system, such as the adjustable storage system 20 shown in FIG. 2, in accordance with an embodiment hereof. The method 800 is represented by blocks 810-820. At block 810, the method includes coupling together a plurality of storage receptacles, such as the adjustable storage receptacles 22 shown in FIG. 2, each storage receptacle comprising a housing, such as the housing 30 shown in FIG. 2, and an opening/closing mechanism, such as the opening/closing mechanism 28 shown in FIG. 2, coupled to the housing, the opening/closing mechanism configured to transition between a closed configuration and an open configuration. At block 820, the method includes coupling a plurality of expansion mechanisms, such as the expansion mechanism 26 shown in FIG. 2, to the plurality of storage receptacles, respectively, such that each expansion mechanism is operable to increase or decrease an interior storage volume of the storage receptacle. It should be noted that in different embodiments, the aforementioned steps may be performed in a different order.

Embodiment 1. An adjustable storage system comprising a plurality of storage receptacles, each storage receptacle comprising a housing, and an opening/closing mechanism coupled to the housing, the opening/closing mechanism configured to transition between a closed configuration and an open configuration; and a plurality of expansion mechanisms, each expansion mechanism coupled to one of the plurality of storage receptacles and operable to increase or decrease an interior storage volume of the storage receptacle.

Embodiment 2. The system of embodiment 1, wherein the plurality of storage receptacles are coupled together, forming a plurality of rows and a plurality of columns.

Embodiment 3. The system of embodiment 1 or 2, wherein the opening/closing mechanism comprises a pivoting door.

Embodiment 4. The system of any of embodiments 1-3, wherein the opening/closing mechanism comprises a rolling door.

Embodiment 5. The system of any of embodiments 1-4, wherein the opening/closing mechanism comprises an Iris-style mechanism.

Embodiment 6. The system of any of embodiments 1-5, wherein the expansion mechanism comprises a flexible material.

Embodiment 7. The system of any of embodiments 1-6, wherein the expansion mechanism comprises an accordion-like mechanism.

Embodiment 8. The system of any of embodiments 1-7, further comprising a plurality of biasing elements, each biasing element coupled to one of the plurality of storage receptacles and configured to resist expansion of the storage receptacle.

Embodiment 9. The system of any of embodiments 1-8, wherein the biasing element is a spring.

Embodiment 10. The system of any of embodiments 1-9, wherein the biasing element is a dash-pot.

Embodiment 11. The system of any of embodiments 1-10, further comprising a plurality of direct position control elements, each direct position control element coupled to one of the plurality of storage receptacles.

Embodiment 12. The system of any of embodiments 1-11, wherein the direct position control element comprises a motorized lead screw; a rack-and-pinion gear set; a wire-rope drive; or a roller chain.

Embodiment 13. The system of any of embodiments 1-12, wherein each opening/closing mechanism includes a locking element.

Embodiment 14. A method of using an adjustable storage system comprising a plurality of storage receptacles each having an opening/closing mechanism and an expansion mechanism that is operable to increase or decrease an interior storage volume of the storage receptacle, the method comprising adjusting a first expansion mechanism coupled to a first storage receptacle to increase an interior storage volume of the first storage receptacle; placing a plurality of objects into the first storage receptacle; and transitioning the opening/closing mechanism of the first storage receptacle from a closed configuration to an open configuration to release the plurality of objects.

Embodiment 15. The method of embodiment 14, further comprising, prior to transitioning the opening/closing mechanism from the closed configuration to the open configuration, positioning a bag adjacent to the first storage receptacle, such that an opening of the bag is oriented at least partially towards the opening/closing mechanism.

Embodiment 16. The method of embodiment 14 or 15, wherein the plurality of storage receptacles are oriented at an angle relative to a surface on which the adjustable storage system is supported.

Embodiment 17. The method of any of embodiments 14-16, wherein the plurality of objects are released using gravity.

Embodiment 18. The method of any of embodiments 14-17, wherein the plurality of objects are released using a pusher mechanism coupled to the first storage receptacle.

Embodiment 19. The method of any of embodiments 14-18, wherein the first expansion mechanism is coupled to a biasing element that resists expansion of the first storage receptacle.

Embodiment 20. A method of manufacturing an adjustable storage system, the method comprising coupling together a plurality of storage receptacles, each storage receptacle comprising a housing, and an opening/closing mechanism coupled to the housing, the opening/closing mechanism configured to transition between a closed configuration and an open configuration; and coupling a plurality of expansion mechanisms to the plurality of storage receptacles, respectively, such that each expansion mechanism is operable to increase or decrease an interior storage volume of the associated storage receptacle.

Embodiment 21. Any of embodiments 1-20 in any combination.

In some embodiments, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some embodiments, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C."

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations of elements, as well as use of elements not shown, are also possible and contemplated.

What is claimed is:

1. An adjustable storage system, comprising:

a plurality of storage receptacles, wherein each storage receptacle of the plurality of storage receptacles comprises:

a housing, and a door coupled to the housing, the door configured to transition between a closed configuration and an open configuration to thereby increase or decrease access to an interior storage space of the storage receptacle;

a plurality of expansion mechanisms, wherein each expansion mechanism of the plurality of expansion mechanisms is coupled to one of the plurality of storage receptacles and is operable to increase or decrease an interior storage volume of the storage receptacle; and a plurality of direct position control elements, wherein each direct position control element of the plurality of direct position control elements is configured to control operation of one of the plurality of expansion mechanisms, is coupled to one of the plurality of storage receptacles, and comprises at least one of a motorized lead screw, a rack-and-pinion gear set, a wire-rope drive, or a roller chain.

2. The system of claim 1, wherein the plurality of storage receptacles are coupled together, forming a plurality of rows and a plurality of columns.

3. The system of claim 1, wherein the door comprises a pivoting door.

4. The system of claim 1, wherein the door comprises a rolling door.

5. The system of claim 1, wherein the door comprises an Iris mechanism.

6. The system of claim 1, wherein each expansion mechanism of the plurality of expansion mechanisms comprises a flexible material.

7. The system of claim 1, wherein each expansion mechanism of the plurality of expansion mechanisms comprises an accordion mechanism.

8. The system of claim 1, further comprising a plurality of biasing elements, wherein each biasing element of the plurality of biasing elements is coupled to a storage receptable of the plurality of storage receptacles and is configured to resist expansion of the expansion mechanism of the plurality of expansion mechanisms coupled to the storage receptacle.

9. The system of claim 8, wherein each biasing element of the plurality of biasing elements is a spring.

10. The system of claim 8, wherein each biasing element of the plurality of biasing elements is a dash-pot.

11. The system of claim 1, wherein the door includes a locking mechanism.

12. The system of claim 1, wherein the plurality of storage receptacles is oriented at an angle relative to a surface on which the system is supported.

13. An adjustable storage receptacle comprising:

a housing;

an expansion mechanism coupled to the housing;

a door coupled to a first end of the housing;

a direct position control element, and wherein the door is configured to transition between a closed configuration and an open configuration to thereby increase or decrease access to an interior storage space of the adjustable storage receptacle, the expansion mechanism is operable to increase or decrease an interior storage volume of the adjustable storage receptacle, and the direct position control element is configured to control operation of the expansion mechanism and comprises at least one of a motorized lead screw, a rack-and-pinion gear set, a wire-rope drive, or a roller chain that is configured to control operation of the expansion mechanism.

14. The adjustable storage receptacle of claim 13, wherein the expansion mechanism comprises a mechanical, sliding assembly.

15. The adjustable storage receptacle of claim 13, wherein the expansion mechanism comprises an accordion mechanism.

* * * * *